US008388410B2

(12) United States Patent
Albright, Jr.

(10) Patent No.: US 8,388,410 B2
(45) Date of Patent: Mar. 5, 2013

(54) RFID-CONTAINING CARRIERS USED FOR SILICON WAFER QUALITY

(75) Inventor: John Wesley Albright, Jr., Mechanicsburg, PA (US)

(73) Assignee: P.R. Hoffman Machine Products, Inc., Carlisle, PA (US)

( * ) Notice: Subject to any disclaimer, the term of this patent is extended or adjusted under 35 U.S.C. 154(b) by 1147 days.

(21) Appl. No.: 11/935,283

(22) Filed: Nov. 5, 2007

(65) Prior Publication Data

US 2009/0114549 A1 May 7, 2009

(51) Int. Cl.
*B24B 49/00* (2012.01)

(52) U.S. Cl. ..... 451/8; 451/41; 451/269; 451/285

(58) Field of Classification Search ..... 451/5, 8, 451/41, 262, 268, 269, 285–290; 700/121, 700/116, 115, 174
See application file for complete search history.

(56) References Cited

U.S. PATENT DOCUMENTS

| | | | | |
|---|---|---|---|---|
| 1,984,839 | A * | 12/1934 | Murray | 81/DIG. 5 |
| 3,561,167 | A * | 2/1971 | Borganti | 451/324 |
| 5,570,293 | A * | 10/1996 | Tanaka et al. | 700/121 |
| 5,640,002 | A | 6/1997 | Ruppert et al. | |
| 6,330,971 | B1 * | 12/2001 | Mabry et al. | 235/383 |
| 6,718,223 | B1 * | 4/2004 | Iwakata et al. | 700/121 |
| 6,722,948 | B1 * | 4/2004 | Berman | 451/21 |
| 7,044,373 | B1 | 5/2006 | Garber et al. | |
| 7,158,850 | B2 * | 1/2007 | Cheng et al. | 700/121 |
| 7,563,153 | B2 * | 7/2009 | Haddadi | 451/8 |
| 7,840,305 | B2 * | 11/2010 | Behr et al. | 700/174 |
| 7,963,823 | B2 * | 6/2011 | Fischer | 451/8 |
| 2002/0104013 | A1 | 8/2002 | Ghazarian | |
| 2002/0116267 | A1 | 8/2002 | Weisz et al. | |
| 2004/0098272 | A1 | 5/2004 | Kapsis et al. | |
| 2004/0122685 | A1 | 6/2004 | Bunce | |
| 2004/0163051 | A1 | 8/2004 | Hepworth et al. | |
| 2004/0181467 | A1 | 9/2004 | Raijani et al. | |
| 2004/0238623 | A1 * | 12/2004 | Asp | 235/380 |
| 2005/0040231 | A1 | 2/2005 | Allison et al. | |
| 2006/0011721 | A1 | 1/2006 | Olsen, III et al. | |
| 2006/0014475 | A1 * | 1/2006 | Sekiya | 451/5 |
| 2006/0145856 | A1 | 7/2006 | Tethrake et al. | |
| 2006/0190185 | A1 | 8/2006 | Ford et al. | |
| 2006/0221363 | A1 | 10/2006 | Roth et al. | |
| 2008/0004743 | A1 * | 1/2008 | Goers et al. | 451/5 |
| 2008/0057830 | A1 * | 3/2008 | Molnar | 451/5 |
| 2009/0053837 | A1 * | 2/2009 | Khoche et al. | 438/14 |
| 2009/0053983 | A1 * | 2/2009 | Hosaka et al. | 451/527 |

FOREIGN PATENT DOCUMENTS

| | | | |
|---|---|---|---|
| WO | 2004084024 | A2 | 9/2004 |
| WO | 2004017613 | A1 | 10/2007 |

* cited by examiner

*Primary Examiner* — Maurina Rachuba

(74) *Attorney, Agent, or Firm* — McNees Wallace & Nurick LLC

(57) ABSTRACT

A carrier configured for use in a lapping machine includes a body having a first opening for carrying a work piece during operation of the lapping machine. A device is arranged and disposed in the body. The device is configured to retain information readable by a reading device for identifying the body.

13 Claims, 5 Drawing Sheets

RFID-CONTAINING CARRIERS USED FOR SILICON WAFER QUALITY

FIELD OF THE INVENTION

The present invention relates generally to carriers used with lapping machines and, more particularly, to carriers configured for quality control of work pieces produced after being structurally carried by carriers used with lapping machines.

BACKGROUND OF THE INVENTION

Lapping machines, such as lapping machine 10 shown in FIG. 1, typically include at least a ring sprocket 16 having a lower lapping wheel 32 and a center sprocket 12. The ring sprocket 16 has a radius 18 and center sprocket 12 has a radius 14. During operation of lapping machine 10, center sprocket 12 rotates about a center axis 24. Teeth of a carrier 20 mesh with the teeth of ring sprocket 16 and the teeth of center sprocket 12 so that carrier 20 is urged into simultaneous rotational movement about its center axis 26 and planetary movement between radius 14 and radius 18. Carrier 20 includes one or more openings 22 for carrying a work piece 28, such as a disk that is exposed to lower lapping wheel 32 during operation. The diameter 30 of carrier 20 is a fixed distance, equal to the difference between radius 18 of ring sprocket 16 and radius 14 of center sprocket 12. By virtue of movement of carrier 20, work pieces 28 are subjected to abrasive contact with lower lapping wheel 32, ultimately forming planar surfaces on work pieces 28 having surfaces small discontinuities/variances in flatness. It is desirable to maintain extremely high surface tolerance control for proper function of the work pieces 28 used in semiconductors.

Over time, carriers are subject to wear, producing work pieces having unacceptably low levels of tolerance control, requiring replacement of the carriers. As a result, testing must be conducted that correlate work piece quality to the carriers used to produce the work pieces. Currently, an identification number is formed in or placed on each carrier requiring manual recordation of the carrier number for each lot or group of work pieces produced using a carrier. Manual recordation is time-consuming, prone to errors, and does not sufficiently isolate the carrier so as to identify a single "bad" opening, requiring possible premature disposal of a carrier.

What is needed is a carrier that is configured for testing as part of a work piece quality control system which does not require manual identification of the carrier, yet more quickly and more accurately identifies the carrier used to produce a given lot or group of work pieces.

SUMMARY OF THE INVENTION

The present invention relates to a carrier for use in a lapping machine including a body having a first opening for carrying a work piece during operation of the lapping machine. A device is arranged and disposed in the body. The device is configured to retain information readable by a reading device for identifying the body.

The present invention further relates to a carrier for use in a lapping machine including a body having a first opening for carrying a work piece during operation of the lapping machine. The body has opposed surfaces in close proximity with the lapping machine. A device is arranged and disposed in the body between the opposed surfaces. The device is configured to retain information readable by a reading device for identifying the body.

The present invention yet further relates to a method for providing quality control associated with processing of work pieces. The method includes providing a body having a first opening for carrying a work piece during operation of a lapping machine and positioning a device in the body, the device configured to retain information readable by a reading device associated with identification of the body. The method further includes reading the device information by the reading device corresponding to processing of a work piece.

An advantage of the present invention is it permits inventory control of work pieces associated with carriers without requiring manual recordation of the identity of the carrier.

A further advantage of the present invention is that a device secured in the carrier for identification of the carrier should function throughout the life cycle of the carrier.

A still further advantage of the present invention is that a substance used to secure the device in a carrier can be color coded to more easily visually identify the carrier.

A yet further advantage of the present invention is that a plurality of devices may be secured in a carrier associated with individual carrier openings, permitting identification of specific openings of the carrier for improved quality control of work pieces, as well as providing an extended life cycle of the carrier.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
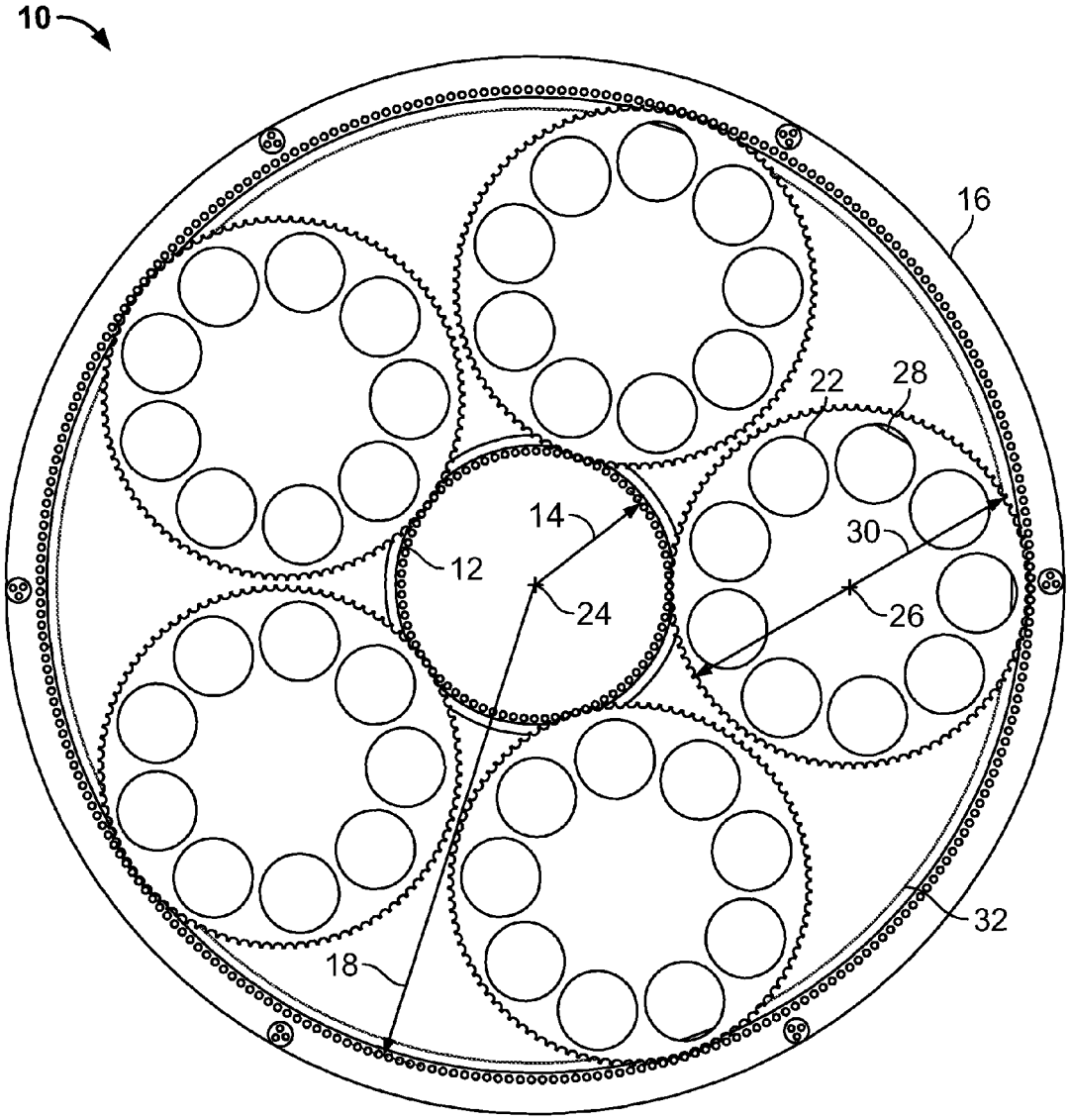
FIG. 1 (Prior Art)
FIG. 1 is a plan view of a prior art lapping machine.
Figure 2:
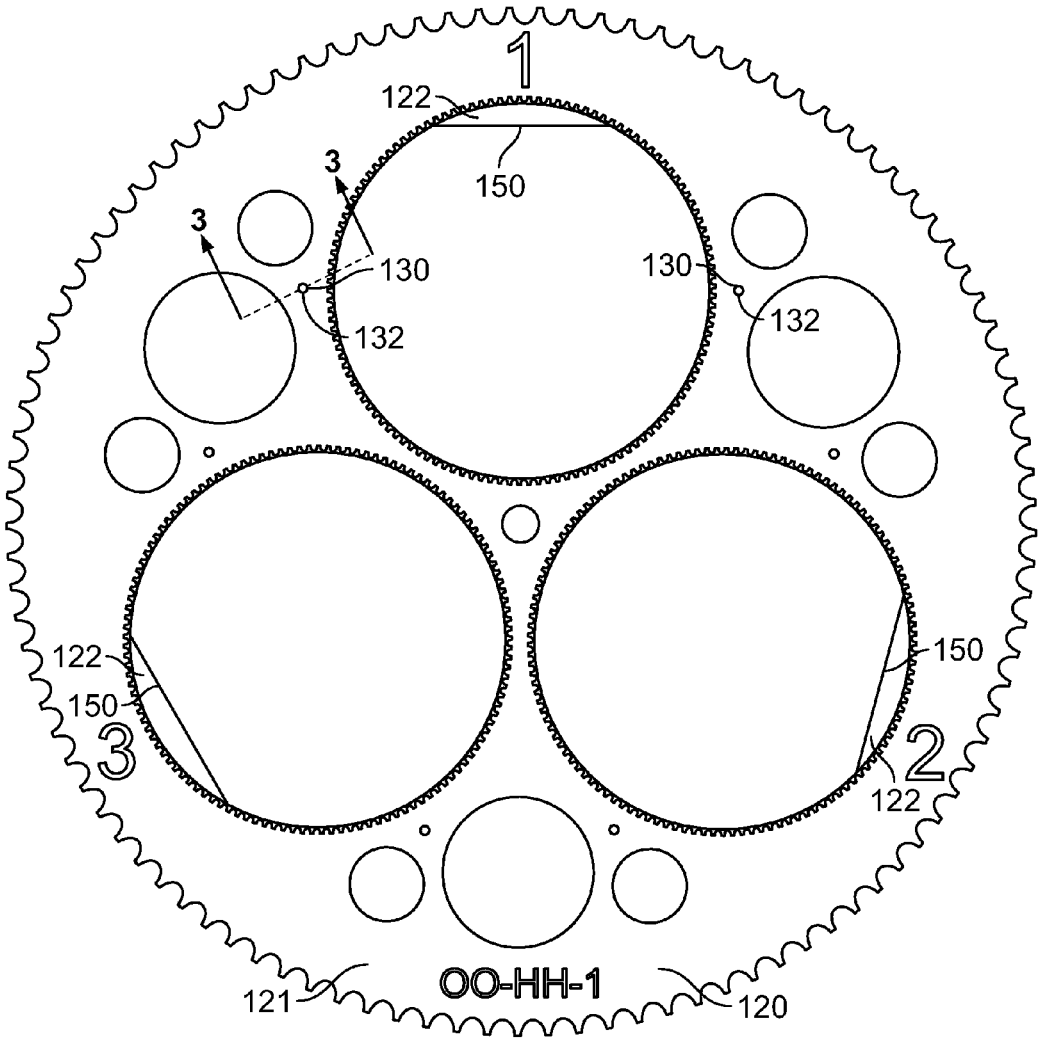
FIG. 2 is a plan view of an embodiment of a carrier of the present invention.
Figure 3:
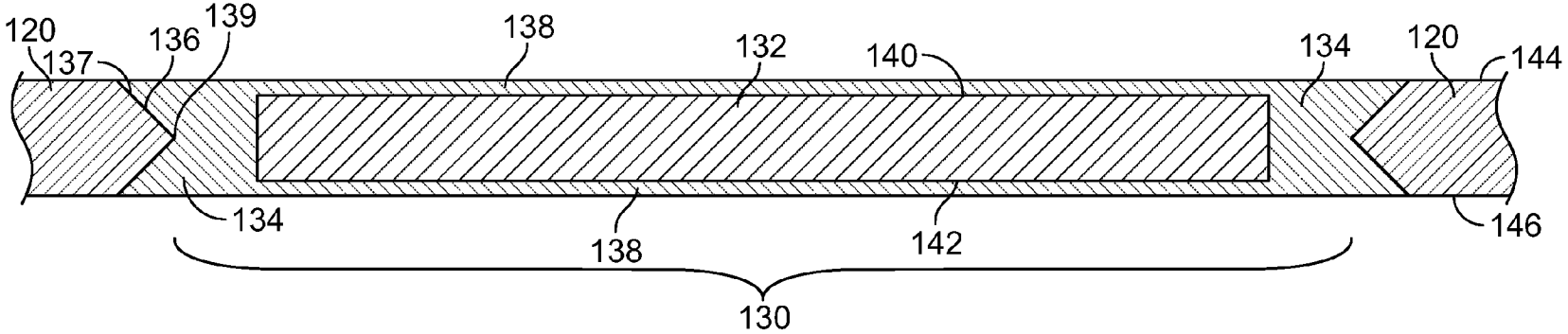
FIG. 3 is a cross-section of an embodiment of an information retaining device taken along line 3-3 of FIG. 2 of the present invention.

Referring to FIGS. 2-3, a carrier 120 (FIG. 2) according to the present invention includes a body 121 having openings 122 formed therein that are configured to receive corresponding work pieces 150. In one embodiment work pieces 150 are composed of a material usable to construct a semiconductor. In one embodiment, teeth 148 are disposed along the periphery of carrier 120 to mesh with corresponding sprockets of a lapping machine of conventional construction to impart a known relative rotational movement of the carrier with respect to the lapping machine. This relative movement results in abrasive contact between the work pieces 150 and a wheel disposed underneath the work pieces, and in one embodiment, wheels disposed both beneath and above the work pieces. In addition, as shown, an opening 130 is formed in carrier 120 to receive a device 132 configured to store information for identifying carrier 120 in association with processing of a lot or grouping of work pieces 150. In one embodiment, opening 130 does not extend through body 121, such as a recess, slot or other surface discontinuity formed in one side of the body of sufficient size to receive device 132. A reading device (not shown) is configured to read or access the information stored on device 132. In this way, the particular lot or grouping of work pieces 150 can be quickly, conveniently, and accurately associated with a particular carrier 120.

It is to be understood that in one embodiment, carrier 120 may be configured to receive one or more work pieces and multiple identifying devices.

In one embodiment, device 132 may be configured for use with radio frequency identification (RFID), including a compatible reading device. An example of a reading device is a Falcon 550 Series RFID Mobile Computer manufactured by PSC Technologies, headquartered in Virginia Beach, Va. However device 132 is not limited to RFID, and may make use of other identification techniques, such as a microwave-based identification system. In another embodiment, optical bar codes or other techniques suitable for use with carriers, lapping machines and the work pieces produced by carriers and lapping machines may also be used, and the associated reading devices, if desired.

The device and reading device of the present disclosure is intended to enhance quality control associated with producing work pieces by the reading device reading the information retained or stored by the device. At least a portion of the information stored by the device is associated with the identification of the carrier in which the device is installed. The particular quality control techniques available to a manufacturer and integration of those techniques are virtually limitless, well known, and are not further discussed herein, and include the capability of reading the device when the opening formed in the carrier body is not formed through the carrier body.

Figure 4:
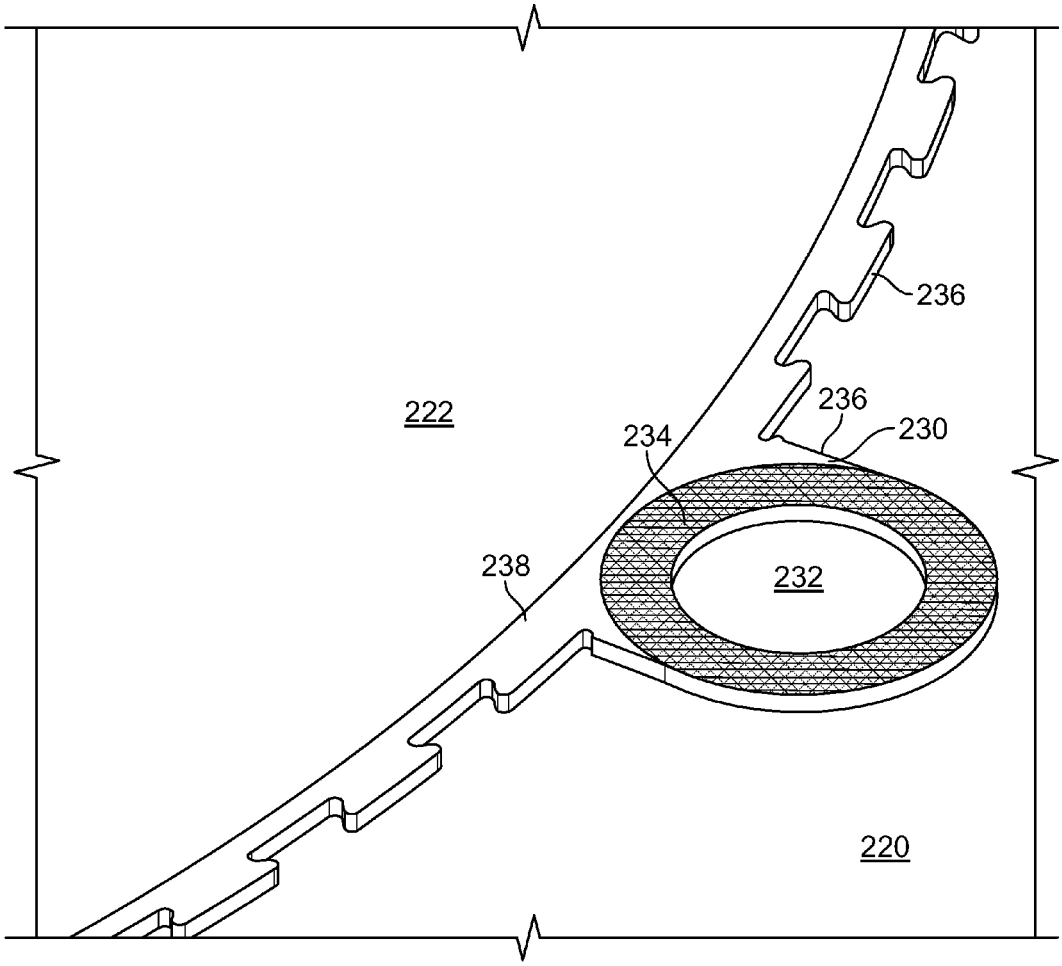
FIGS. 4 and 5 are enlarged partial plan views of openings formed in alternate embodiments of a carrier of the present invention.

FIG. 3 shows a cross-section taken along line 3-3 of FIG. 2 through opening 130 of carrier 120. Opening 130 includes a surface feature 136 formed along at least a portion of the periphery of opening 130, such as a pair of opposed angled protrusion portions 137 forming an apex 139 as further shown in FIG. 3. However, other surface features may also be formed along the periphery of opening 130. As used herein, the term surface feature is intended to refer to enhancements to the peripheral surface, i.e., a perpendicular through opening, formed along the periphery of an opening formed in a carrier to enhance retention of a substance installed in the carrier opening. That is, the term surface feature includes roughening of at least a portion of the peripheral surface opening, by suitable techniques, such as grit blasting or grinding, which may be used alone or in combination with other features, such as protrusions or recesses formed along the periphery of the carrier opening. It is to be understood that the term surface feature includes one contiguous feature, although a plurality of surface features may be spaced apart along the periphery of the opening. It is also to be understood that opening 130 can define a geometry other than circular profile, and that as will be discussed in additional detail below, as shown in FIG. 4 in an alternate carrier construction, opening 230 and opening 222 may form a single opening.

Referring back to FIGS. 2-3, a substance 134 is secured to surface feature 136 of carrier 120, with device 132 further secured to substance 134 so that device 132 is secured within opening 130 of carrier 120. As shown, the thickness of device 132 is less than the thickness of carrier 120, with opposed surfaces 140, 142 of device 132 disposed between opposed surfaces 144, 146 of carrier 120. As further shown in FIG. 3, a layer 138 of substance 134 is disposed between surface 140 of device 132 and surface 144 of carrier 144. Similarly, a layer 138 of substance 134 is disposed between surface 142 of device 132 and surface 146 of carrier 144. In one embodiment, substance 134, including layers 138, substantially surround device 132, protecting device 132 from abrasive contact and/or fluids associated with operation of the lapping machine. For example, in one embodiment, the device measures 0.350 inch in diameter and 0.028 inch thick, carrier 120 is 0.030 inch thick, opening 130 has a diameter of 0.550 inch, with layers 138 applied flush with opposed surfaces 144, 146 so that layers 138 are 0.001 inch thick. That is, in this non-limiting embodiment, device 132 is substantially centered in opening 130. However, it is to be understood that device 132 may be substantially the same thickness as carrier 120 so that layer 138 may not be present, and in addition, device 132 may not be centered in the carrier opening.

In one embodiment, device 132 is configured so that as long as device 132 is placed in opening 130 with surfaces 140, 142 substantially flush or recessed between surfaces 144, 146 of carrier 120, information stored by device 132 is retained and accessible by a reading device for the life cycle of the carrier 120. That is, in this embodiment, a portion of device 132 may be removed during the normal life cycle of the carrier 120 without removing the information stored by device 132.

It is to be understood that substance 134 is composed of a material that will permit the reading device to read the information stored by device 132, such as a plastic or an adhesive. In addition, pigment may be added to substance 134 so that the substance can be produced in different colors, providing a visual means of identification of carriers, in addition to information stored in device 132 that is readable by the reading device. That is, substance 134 of carriers having different lot numbers or different manufacturing dates, or other distinguishing characteristics, may have different pigments to more easily locate the carrier of interest from a distance.

Figure 5:
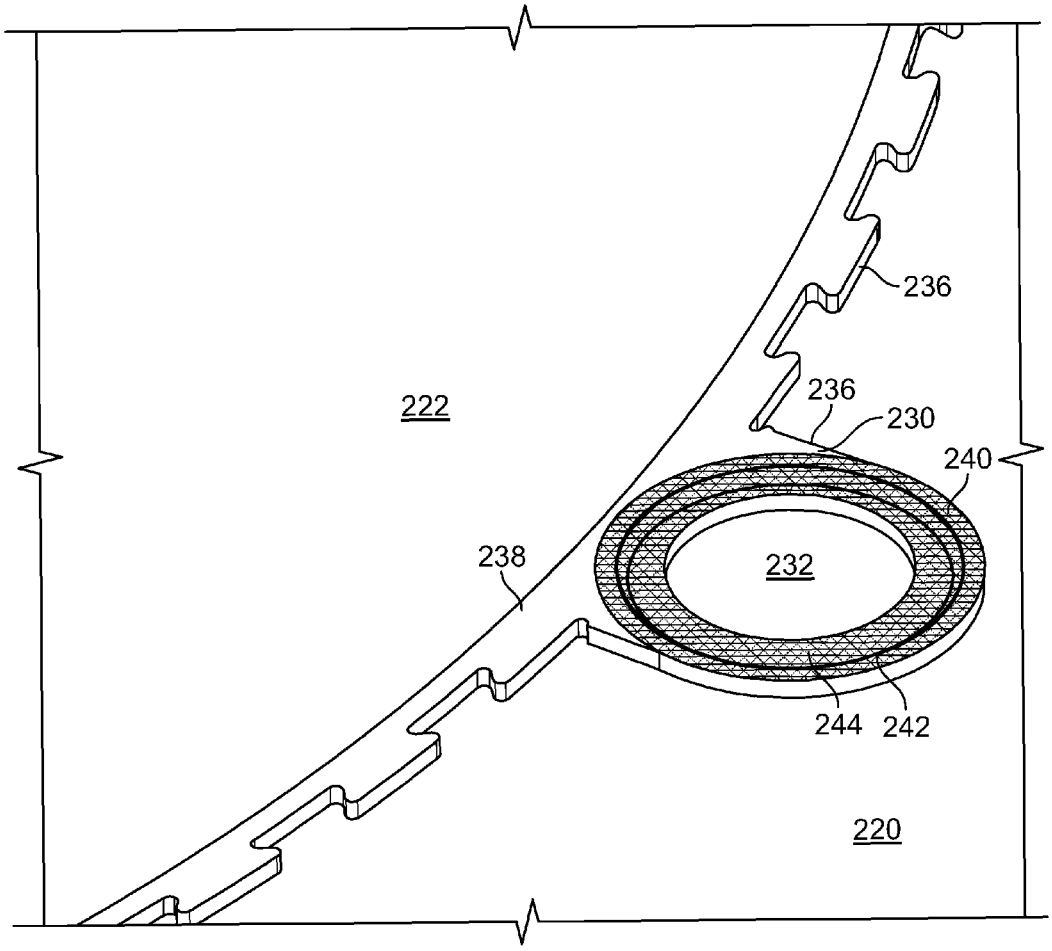

FIG. 4 shows an alternate embodiment of carrier 220, otherwise similar to carrier 120, in which openings 222 and 230 are interconnected, i.e., openings 222 and 230 forming a single opening. In one embodiment of this construction, substance 238 and 234 are formed simultaneously, with substance 234 further including an opening 232 for securing device (not shown in FIG. 4). In one embodiment, the device may be molded in position in substance 234, so formation of opening 232 would not be required. In further alternate non-limiting constructions as shown in FIG. 5, an optional insert 240 may be placed in opening 230, providing a closed geometry (as shown in FIG. 5) or at least substantially closed geometry. In another embodiment, insert 240 further includes a surface feature 242 for securing an additional substance 244 including an opening 232 for securing device (not shown in FIG. 5). In yet a further embodiment, the device may be molded in position in substance 244, so formation of opening 232 would not be required.

Referring back to FIG. 2, a pair of openings 130 and devices 132 are disposed adjacent to each larger opening 122. In such construction, a pair of devices 132 correspond to work pieces 150 produced in the adjacent opening 122. That is, if quality control testing indicates that work pieces 150 associated with a position 1 of carrier 120 (12 o'clock position as shown in FIG. 2) are unacceptable, but that work pieces 150 associated with positions 2 and 3 (4 o'clock and 8 o'clock positions as shown in FIG. 2) are acceptable, carrier 120 may continue to be used to prepare work pieces 150 disposed in positions 2 and 3, if desired.

It is to be understood that other arrangements of openings for securing work pieces and openings for securing devices may be used.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A carrier for use in a lapping machine comprising:

a body having a first opening for holding a work piece composed of a semiconductor or a rigid material having opposed surfaces against and between corresponding opposed surfaces of a lapping machine, resulting in abrasive contact between the corresponding opposed surfaces of the work piece and the lapping machine during movement of the opposed surfaces of the lapping machine with respect to the opposed surfaces of the work piece, the body having opposed surfaces in close proximity with the opposed surfaces of the lapping machine; and a device arranged and disposed in the body between the opposed surfaces, the device configured to retain information readable by a reading device for only identifying the body in association with processing a work piece in the lapping machine.

2. The carrier of claim 1, wherein the device is a radio frequency identification marker.

3. The carrier of claim 1, wherein the substance is a plastic.

4. The carrier of claim 1, wherein the substance is an adhesive.

5. The carrier of claim 1, wherein the substance is provided in different colors.

6. The carrier of claim 1, wherein the device is disposed in a second opening, the first and second opening forming a single opening.

7. The carrier of claim 1, wherein the device is substantially surrounded by a substance fixedly securing the device in the body, the body information is configured to be readable through the substance by the reading device.

8. A method for providing quality control associated with processing of work pieces in a lapping machine, the method comprising:

providing a body having a first opening for holding opposed surfaces of a work piece composed of a semiconductor or a rigid material against and between corresponding opposed surfaces of a lapping machine, resulting in abrasive contact between the corresponding opposed surfaces of the work piece and the lapping machine during movement of the opposed surfaces of the lapping machine with respect to the opposed surfaces of the work piece;

positioning a device in the body, the device configured to retain information readable by a reading device only associated with identification of the body in association with processing a work piece in the lapping machine; and reading the device information by the reading device.

9. The method of claim 8, wherein a substance is used to position the device in the body.

10. The method of claim 9, wherein the reading device is configured to read device information through the substance.

11. The method of claim 9, wherein the substance is provided in difference colors.

12. The method of claim 8, wherein reading the device information includes information associated with identification of the body.

13. A carrier for use in a lapping machine comprising:

a body having a first opening for holding a first work piece and a second opening for holding a second work piece, the first work piece and the second work piece composed of a semiconductor or a rigid material having opposed surfaces against and between corresponding opposed surfaces of a lapping machine, resulting in abrasive contact between the corresponding opposed surfaces of the work pieces and the lapping machine during movement of the opposed surfaces of the lapping machine with respect to the opposed surfaces of the work pieces, the body having opposed surfaces in close proximity with the opposed surfaces of the lapping machine; and a first device arranged and disposed in the body between the opposed surfaces and in close proximity to the first opening and a second device arranged and disposed in the body between the opposed surfaces and in close proximity to the second opening, the first device and the second device configured to retain information readable by a reading device for only identifying the corresponding first opening in the body and the second opening in the body in association with processing the corresponding first work piece and second work piece in the lapping machine.

* * * * *